US010958999B2

(12) United States Patent
Rissanen et al.

(10) Patent No.: US 10,958,999 B2
(45) Date of Patent: Mar. 23, 2021

(54) LOUDSPEAKER

(71) Applicant: Genelec Oy, Iisalmi (FI)

(72) Inventors: Ilkka Rissanen, Iisalmi (FI); Tommi Paavilainen, Iisalmi (FI); Harri Koskinen, Iisalmi (FI)

(73) Assignee: Genelec Oy, Iisalmi (FI)

( * ) Notice: Subject to any disclaimer, the term of this patent is extended or adjusted under 35 U.S.C. 154(b) by 0 days.

(21) Appl. No.: 16/503,386

(22) Filed: Jul. 3, 2019

(65) Prior Publication Data

US 2020/0021906 A1 Jan. 16, 2020

(30) Foreign Application Priority Data

Jul. 13, 2018 (FI) ..... 20185641

(51) Int. Cl.
*H04R 1/02* (2006.01)
*H04R 1/28* (2006.01)
(Continued)

(52) U.S. Cl.
CPC ..... *H04R 1/026* (2013.01); *H04R 1/025* (2013.01); *H04R 1/22* (2013.01); *H04R 1/28* (2013.01); *H04R 1/2803* (2013.01); *H04R 1/2815* (2013.01); *H04R 1/2819* (2013.01); *H04R 1/2823* (2013.01); *H04R 1/2826* (2013.01);
(Continued)

(58) Field of Classification Search
CPC ..... H04R 1/025; H04R 1/026; H04R 1/22; H04R 1/24; H04R 1/2815; H04R 1/2819; H04R 1/2826; H04R 1/345; H04R 1/28; H04R 1/2803; H04R 1/2823; H04R 2201/02; F16M 11/046; F16M 11/20; F16M 11/22; F16M 11/24; F16M 11/26; F16M 11/32; F16M 13/02; F16M 13/025; F16M 2200/08; F16M 2200/028; A47B 91/02;
(Continued)

(56) References Cited

U.S. PATENT DOCUMENTS 5,681,023 A * 10/1997 Sheydayi ..... H04R 1/026 248/346.11
9,462,373 B2 * 10/2016 Kulomaki ..... H04R 1/02
(Continued)

FOREIGN PATENT DOCUMENTS

CN 205961358 U 2/2017
CN 206713006 U 12/2017
(Continued)

OTHER PUBLICATIONS

Vibro, "Comparison of vibration isolators with silicone to anti-vibration products made of natural rubber compounds", Aug. 19, 2014, Vibration Vibration Control Products, all pages. (Year: 2014).*
(Continued)

*Primary Examiner* — Jesse A Elbin
(74) *Attorney, Agent, or Firm* — Chernoff, Vilhauer, McClung & Stenzel, LLP

(57) ABSTRACT

A novel loudspeaker with a reflex enclosure that has the reflex port terminating to the bottom of the enclosure. The loudspeaker further includes a stand which is removably attached to the bottom of the enclosure so as to create a clearance between the bottom and the surface supporting the loudspeaker.

20 Claims, 3 Drawing Sheets

(51) Int. Cl.
*H04R 1/34* (2006.01)
*H04R 1/22* (2006.01)
*H04R 1/24* (2006.01)

(52) U.S. Cl.
CPC ..... *H04R 1/345* (2013.01); *H04R 1/24* (2013.01); *H04R 2201/02* (2013.01)

(58) Field of Classification Search
CPC ... A47B 91/022; A47B 91/024; A47B 91/026; A47B 91/028
USPC ..... 381/87, 332, 333, 337, 338, 345, 348, 381/349; 248/688, 693, 614, 616, 678, 248/149, 154, 160, 177.1, 180.1, 176.3, 248/188, 188.1, 188.2, 188.4, 346.03
See application file for complete search history.

(56) References Cited

U.S. PATENT DOCUMENTS

| | | | | |
|---|---|---|---|---|
| 2003/0218957 | A1* | 11/2003 | Tanishima | F16M 7/00 720/600 |
| 2017/0055701 | A1* | 3/2017 | Latvis, Jr. | A47B 57/46 |
| 2018/0317034 | A1* | 11/2018 | Orth | H04R 5/02 |

FOREIGN PATENT DOCUMENTS

| | | | | | |
|---|---|---|---|---|---|
| EP | 2942974 | A1 | | 11/2015 | |
| GB | 2435206 | A | * | 8/2007 | H04R 1/026 |
| JP | 11243592 | A | | 9/1999 | |
| JP | 2003299171 | A | | 10/2003 | |
| JP | 2006129460 | A | | 5/2006 | |

OTHER PUBLICATIONS

Gary Galo, IsoAcoustics Aperta Speaker Stands—Effective Floating Isolation, audioXpress Magazine, Oct. 2015 [online], pp. 30-36, United States, http://www.isoacoustics.com/wp-content/uploads/2016/03/ISO-AudioXpress-october-2015.pdf.

Accessories for Genelec monitors, Genelec [online], Jul. 2016, pp. 4-8, http://www.genelec.com/sites/default/files/media/Studio%20monitors/Accessories/genelec_accessories_brochure.pdf.

Search Report, Finnish Patent and Registration Office, dated Mar. 8, 2019.

English Translation of Japan Office Action Re: Application No. 2019-128981; dated Oct. 28, 2020.

English Translation of China Office Action Re: Application No. 201910626917.5; dated Dec. 3, 2020.

* cited by examiner

LOUDSPEAKER

FIELD

The present disclosure relates to the field of sound reproduction. In particular, the disclosure relates to construction of a reflex loudspeaker enclosure.

BACKGROUND

Reflex loudspeaker enclosures are an advantageous construction for achieving sound reproduction in low frequencies with a relatively compact enclosure. It has, however, been considered a challenge to balance between optimizing the fluent air flow in the reflex port and the rest of the performance of the loudspeaker.

It is therefore an object of the present proposition to provide a loudspeaker enclosure which makes no compromise between reflex port placement and the overall performance of the loudspeaker or at least provide the public with a useful alternative to existing reflex loudspeakers.

SUMMARY

It is herein proposed a novel loudspeaker with a reflex enclosure that has the reflex port terminating to the bottom of the enclosure. The loudspeaker further includes a stand which is removably attached to the bottom of the enclosure so as to create a clearance between the bottom and the surface supporting the loudspeaker.

The invention is defined by the features of the independent claims. Some specific embodiments are defined in the dependent claims.

Considerable benefits are gained by virtue of the novel proposition. By having the reflex port terminate to the bottom of the enclosure, the baffle of the enclosure is vacated from excess openings, whereby the edges of such openings do not create a source of diffraction to the output of the transducers. Also, by omitting the reflex port opening from the baffle the listener is not directly exposed to flow sound emissions or resonances from the reflex port. Also, by omitting the reflex port opening from the baffle the listener is not directly exposed to flow sound emissions or resonances from the reflex port. Furthermore, the baffle may include a large waveguide for directing the sound produced by the high-frequency transducer thus improving directivity. The clearance provided by the stand elevates the reflex port opening from the surface supporting the loudspeaker thus enabling free air flow in the reflex port. The stand is removable for other than tabletop installations, e.g. for suspending the loudspeaker to a wall with a separate bracket or other mounting accessory, wherein the bottom of the enclosure is clear even without the stand.

BRIEF DESCRIPTION OF THE DRAWINGS

In the following certain embodiments are described in greater detail with reference to the accompanying drawings, in which.

EMBODIMENTS

Figure 1:
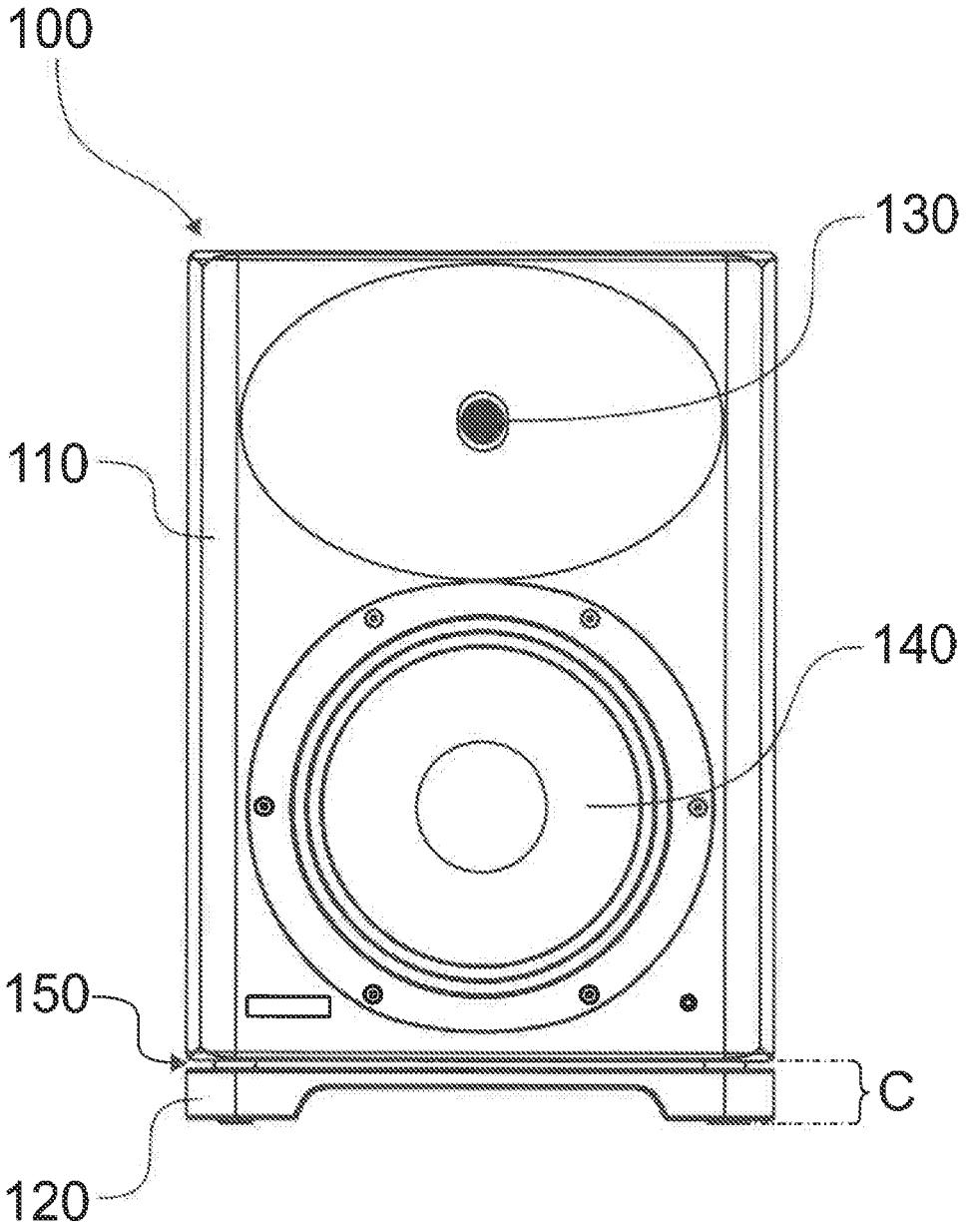
FIG. 1 illustrates a front plan view of a loudspeaker in accordance with at least some embodiments of the present invention.
Figure 2:
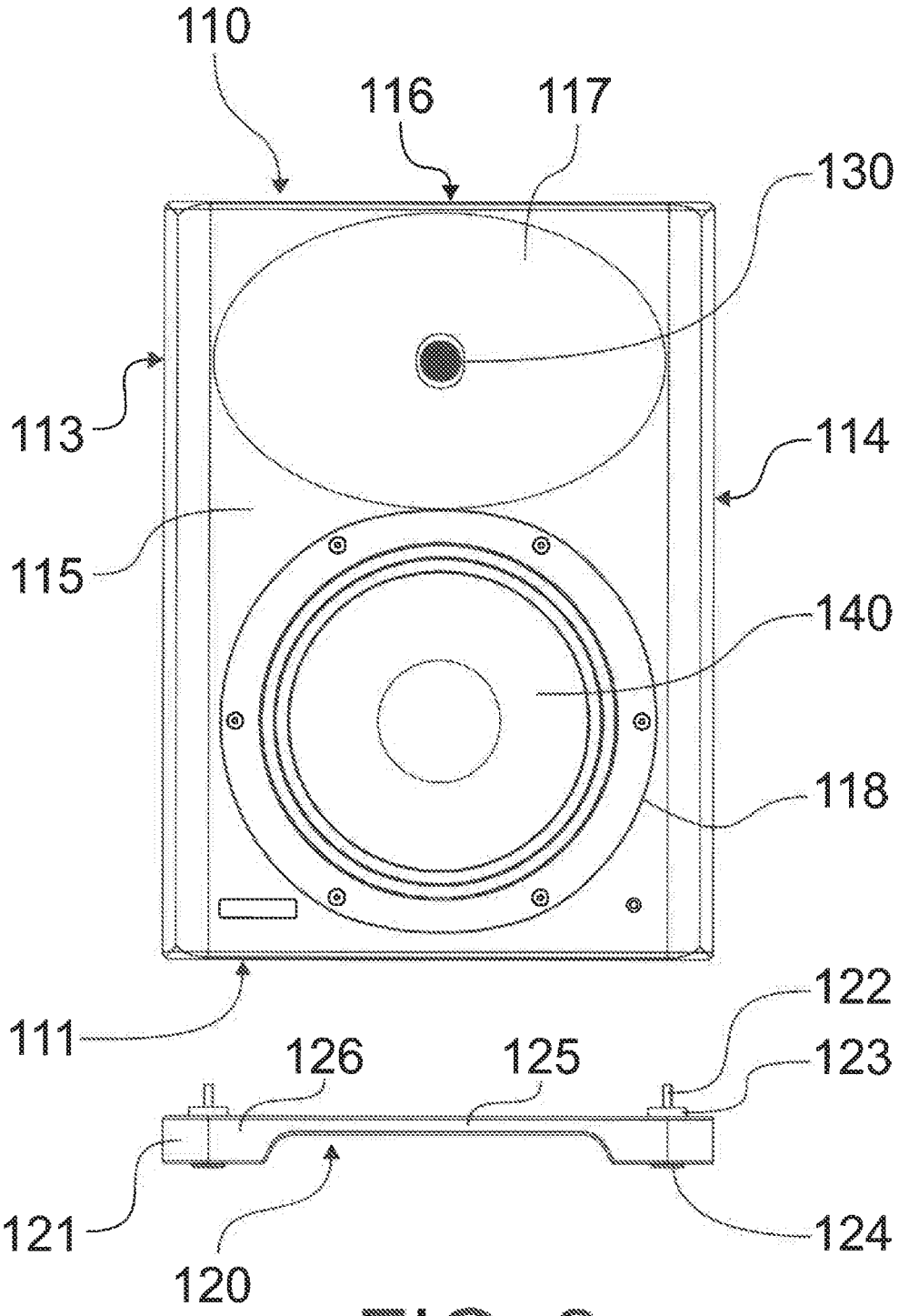
FIG. 2 illustrates an exploded view of the loudspeaker of FIG. 1.
Figure 3:
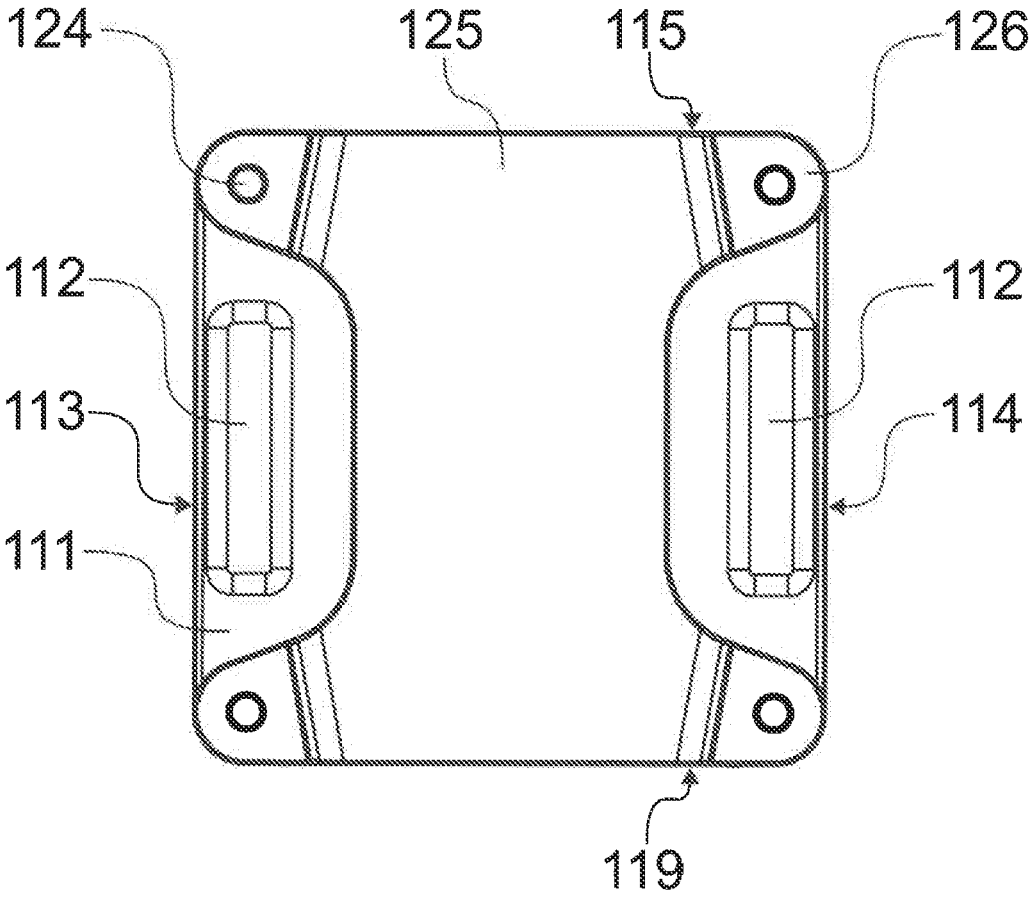
FIG. 3 illustrates a bottom plan view of the loudspeaker of FIG. 1.

As depicted in FIGS. 1 to 3, an embodiment of the present proposition features a loudspeaker 100 with a reflex enclosure 110. The enclosure 110 has a generally cuboid shape, i.e. six faces connected to each other in approximately right angles. The shape is obviously not an exact rectangular prism but resembles a conventional box-like enclosure. As shown in the FIGURES, the corners may be rounded, chamfered (not shown), or otherwise lightened. The faces are also preferably generally planar or they at least include planar sections. The enclosure 110 may be made of a wood based material. According to one embodiment, the load-bearing structure of the enclosure 110 is constructed of wood. According to another embodiment, the load-bearing structure of the enclosure 110 is constructed of a composite having wood and a filler. According to one embodiment, the load-bearing structure of the enclosure 110 is constructed of fibreboard such as MDF.

The faces include a baffle 115, which is in this context is the front face of the loudspeaker and acts as a mounting point for the transducers 130, 140. The baffle 115 has a woofer opening 118 for receiving a low-frequency transducer 140 which may be a woofer, a mid-range transducer, or a compound transducer producing mid-range and low frequencies. The baffle 115 also includes a waveguide 117 for receiving a high-frequency transducer 130, which may be a tweeter or a compound transducer producing high and mid-range frequencies. The waveguide 117 may be a recessed surface, such as a conical or having a truncated cone shape with a circular or elliptic or other suitable shape. The outer edge of waveguide 117 is expressed as an elliptic shape line drawn to FIGS. 1 and 2 to signify the line from which the waveguide 117 is recessed in respect to the frontal face surface of the baffle 115. It is preferred that the waveguide 117 is relatively large for efficient directivity. It is particularly preferable that the waveguide 117 extends across the width of the planar section of the baffle 115. This is presented with the vertical shape lines drawn adjacent to the waveguide 117 in FIGS. 1 and 2 to signify that the waveguide 117 extends to the rounded corner of the baffle 115.

The faces also include a first side 113 and a second side 114 which surround the baffle 115 and are connected thereto through right, rounded corners. The first and second sides 113, 114 are parallel in respect to each other and generally planar. The sides 113, 114 are connected by a top 116 and bottom 111 through right, rounded corners. The top 116 and bottom 111 oppose each other, are parallel in respect to each other and generally planar. The bottom face, i.e. the bottom 111, is generally flat meaning that the enclosure does not include integral legs or stands. Obviously the bottom 111 may include rounded corners or minor curvaceous shapes but the overall appearance of the bottom 111 of the enclosure 110 is planar. This, in turn, means that should the enclosure be placed on a supporting surface without the stand 120 (explained in greater detail hereafter) the reflex port 112 (explained in greater detail hereafter) would be partially or fully closed by the supporting surface. The rear 119 is a closing member that connects the rear edges of the sides 113, 114, top 116, and bottom 111 to each other. The rear 119 may be generally planar wall section opposing the baffle and including terminals for connection to a power outlet, sound signal inputs, etc. The enclosure 110 may be covered by a continuous or discontinuous protective coating, such as an impact resistant paint.

As mentioned, the enclosure 110 is a reflex enclosure meaning that it comprises at least one reflex port 112. The reflex port 112 is constructed to terminate to the bottom 111 of the enclosure 110. This means that the reflex port opening is provided to the bottom 111. The reflex port 112 may include a designated tube or other channel structure inside the enclosure or it may include a wall which forms the reflex port 112 in cooperation with the adjacent side 113, 114. In the illustrated embodiment the enclosure 110 has two reflex ports 112. One reflex port 112 is located adjacent to the first side 113 and the other to the second side 114. It is preferable that the reflex ports 112 are situated to the periphery of the bottom 111 of the enclosure 110 and, if possible, aligned with the adjacent side, as depicted.

A stand 120 may be attached to and detached from the bottom 111 of the enclosure. When attached, the stand 120 produces a clearance C between the bottom 111 and the surface supporting the loudspeaker 100, such as a table top. Accordingly, the stand 120 may be referred to as a table stand. This is to distinguish from tall stands that elevate the loudspeaker from the ground by several tenths of a meter. Such stands are generally referred to as floor stands. Instead, the stand 120 creates a clearance C which is, according to one embodiment, is at most 200 mm. According to a more particular embodiment, the clearance C is at most 100 mm. According to a more particular embodiment, the clearance C is at most 50 mm. According to a more particular embodiment, the clearance C is between 30 to 40 mm. The illustrated example exhibits a clearance C of 36 mm. Such clearance C strikes a balance between stability and sufficient aspiration space for the reflex port 112.

The stand 120 has a body 121 which is preferably elastic to isolate vibrations transmitting between the enclosure 110 and the surface supporting the loudspeaker 100. More specifically, it is preferred that the body 121 of the stand 120 has a larger damping coefficient than that of the enclosure 110. It is beneficial, therefore, that the stand 120 has a natural frequency which is lower than the low end of the response frequency range of the loudspeaker 100. In this context the low end of the range may be seen as the lowest reproduced sound frequency at 3 dB from peak value. Flexible materials are thus preferred for the body 121. Such materials include rubber, composite comprising rubber, and various elastomers. The raw material of the body 121 may have reinforcements, such as embedded steel, carbon fibre, or other rigid filings or structures.

The body 121 is shaped to circumvent the reflex port opening(s) to create a free space between the reflex port openings and the surface supporting the loudspeaker 100. In other words, the body 121 does not extend between the reflex port 112 and the surface supporting the loudspeaker 100. To facilitate the free space, the body 121 includes a web 125, i.e. a central portion, which is located between the reflex port openings, when the stand 120 is attached to the enclosure 110. Provided to the far-most corners of the web 125 there are legs 126, which also elevate the web 125 from the surface supporting the loudspeaker. According to the illustrated embodiment, the stand 120 has four legs 126, but fewer would suffice, such as three. Alternatively, the stand 120 could have a solitary leg, such as a cylindrical leg, but a plurality of legs is preferred for the sake of stability.

Attachment of the stand 120 to the enclosure 110 may be constructed in several alternative ways. According to the illustrated embodiment, the connection is set up in two stages. First, adaptors 123 are connected to the enclosure 110. To engage the stand 120, the bottom 111 of the enclosure 110 has a coupling form which is designed to cooperate with a respective coupling form provided to the stand 120. For example, the bottom 111 has a female coupling form and the stand 120 has male coupling form, although this set up may be reversed. According to the illustrated embodiment the enclosure has several, particularly four, threaded openings provided to the corner regions of the generally quadrilateral bottom 111. The stand 120 has respective threaded shafts 122 that are designed to engage the threaded openings of the bottom 111. In theory, only one threaded or other shape coupling connection could suffice. Particularly, the threaded shafts 122 may be part of a bolt or they may be integrated, such as by bonding through vulcanization, to an elastic bushing. According to the shown example, the threaded shafts 122 form part of an adaptor 123, which has the threaded shaft 122 extending from an elastic body, which may be of similar material to the body 121 of the stand 120. The adaptors 123 are dialled in place through the threaded connection between the shaft and the opening on the bottom 111. The adaptors 123 are on the other hand inserted into receptive openings provided to the top surface of the stand, particularly to the legs 126. Alternatively, the stand 120 may be simply bolted through to the enclosure 110, if adaptors 123 are not used. The use of adaptors 123, however, brings an advantage. The recesses on the body 121 of the stand 120 for receiving adaptors are preferably shallow such that the adaptors 123 protrude from the top surface of the stand 120. That way a gap 150 is created between the body 121 of the stand 120 and the bottom 111 of the enclosure 110. The gap 150 further improves the isolation of the enclosure 110 from the surface supporting the loudspeaker 100. The gap 150 may have a height of 2 to 20 mm, preferably 4 to 10 mm, more preferably 5 mm. Alternatively, the adaptors 123 may reach across the entire height of the body 121. The bottom surface of the body 121, particularly the legs 126, may be sealed with elastic covers 124, such as rubber pads, for covering any hard material otherwise exposed. Such hard material could be used, for example, at bolt heads. The covers 124 also serve the purpose of further isolating the enclosure 110 from the surface supporting the loudspeaker 100. On the other hand they provide extra grip which may be needed to overcome bass recoil in installations on slanted surfaces.

With the stand 120 in place, the reflex ports 112 are free to exhaust air flow towards the surface supporting the loudspeaker 100, i.e. underneath the enclosure 100. The clearance C is enough to enable free flow, whereby the low-end performance of the loudspeaker is not compromised. In particular, the clearance C avoids sound emissions created by the air flow of the reflex port as well as minimizes turbulence compared to not having enough clearance. With the stand 120 removed, the loudspeaker 100 may be attached to a floor stand through a thread insert on the bottom (not shown) or through thread inserts on the sides for attachment to the floor stand through a bracket (not shown), such as a C-shaped bracket. Such a bracket could also be used for a ceiling mount via a suspending shaft. The loudspeaker 100 may alternatively be attached to a wall mount through a thread insert on the rear (not shown).

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

ACRONYMS LIST

MDF medium-density fiberboard

The invention claimed is:

1. A loudspeaker comprising:

an enclosure which comprises a reflex port terminating to a generally flat bottom of the enclosure, the generally flat bottom having a planar portion, the reflex port comprising an opening defined within the planar portion and a stand which is removably attached to the bottom of the enclosure so as to create a clearance between the bottom and a surface supporting the loudspeaker.

2. The loudspeaker according to claim 1, wherein the enclosure is generally cuboidal.

3. The loudspeaker according to claim 1, wherein the enclosure comprises a load-bearing structure which is constructed of at least one of wood and wood composite, particularly of MDF.

4. The loudspeaker according to claim 1, wherein the enclosure comprises a plurality of reflex ports arranged at the periphery of the bottom.

5. The loudspeaker according to claim 1, wherein the stand is shaped to create a free space between the opening of the reflex port and the surface supporting the loudspeaker.

6. The loudspeaker according to claim 1, wherein the stand is a table stand.

7. The loudspeaker according to claim 1, wherein the stand comprises a body which:

has a larger damping coefficient than the enclosure, is constructed of at least one of rubber, and a composite comprising rubber and a composite comprising an elastomer or has a larger damping coefficient than the enclosure and is constructed of at least one of rubber, and a composite comprising rubber and a composite comprising an elastomer.

8. The loudspeaker according to claim 1, wherein the stand is constructed to produce a gap between the body of the stand and the bottom of the enclosure.

9. The loudspeaker according to claim 8, wherein the gap is between 2 to 20 mm.

10. The loudspeaker according to claim 1, wherein the loudspeaker is configured to reproduce sound in a response frequency range, the low end of which is higher than the natural frequency of the stand.

11. The loudspeaker according to claim 1, wherein the bottom of the enclosure and the stand comprise mutually engaging coupling elements for removable attachment.

12. The loudspeaker according to claim 1, wherein:

the bottom of the enclosure comprises at least one threaded opening, and wherein the stand comprises at least one corresponding threaded shaft configured to engage the at least one threaded opening of the bottom.

13. The loudspeaker according to claim 1, wherein the stand comprises at least one adaptor protruding from the top surface of the body of the stand for creating a gap between the body of the stand and the bottom of the enclosure.

14. The loudspeaker according to claim 13, wherein:

at least one threaded shaft is integrated to the adaptor, the body of the stand comprises at least one receiving opening for receiving the at least one adaptor in an embedded fashion, and wherein the at least one adaptor is capable of being first attached to the bottom of the enclosure, before the body of the stand is attached to the at least one adaptor.

15. The loudspeaker according to claim 1, wherein the stand comprises at least one bolt that comprise a threaded shaft, each bolt configured to penetrate the body of the stand and the adaptor and to attach to a threaded opening on the bottom of the enclosure.

16. The loudspeaker according to claim 1, wherein the body of the stand comprises a plurality of legs and a web which connects the legs over the bottom of the enclosure so as to circumvent a reflex port opening.

17. The loudspeaker according to claim 1, wherein the clearance is at most 200 mm.

18. The loudspeaker according to claim 1, wherein a baffle of the enclosure is free of a reflex port opening and comprises a waveguide, wherein the loudspeaker comprises a high-frequency transducer mounted to the waveguide.

19. The loudspeaker according to claim 18, wherein the waveguide extends across the width of a planar section of the baffle.

20. The loudspeaker according to claim 1, wherein the removable stand is configured to not affect air flow out of the reflex port.

* * * * *